United States Patent [19]

Imaizumi

[11] Patent Number: 4,630,365

[45] Date of Patent: Dec. 23, 1986

[54] BLADE REPLACEABLE TYPE BARBER RAZOR

[75] Inventor: Yoshikatsu Imaizumi, Kanagawa, Japan

[73] Assignee: Warner-Lambert K.K., Tokyo, Japan

[21] Appl. No.: 725,001

[22] Filed: Apr. 19, 1985

[30] Foreign Application Priority Data

Oct. 11, 1983 [JP] Japan ..... 58-155772

[51] Int. Cl.[4] ..... B26B 21/10

[52] U.S. Cl. ..... 30/53; 30/66

[58] Field of Search ..... 30/53, 54, 55, 66, 90, 30/151

[56] References Cited

U.S. PATENT DOCUMENTS

| | | | |
|---|---|---|---|
| 2,321,706 | 6/1943 | Salsbury | 30/151 |
| 2,599,439 | 6/1952 | Drake | 30/151 |
| 3,772,778 | 11/1973 | Ishida et al. | 30/53 |
| 4,285,125 | 8/1981 | Chen et al. | 30/53 |
| 4,454,653 | 6/1984 | Chen | 30/53 |

FOREIGN PATENT DOCUMENTS

| | | |
|---|---|---|
| 27267 | 8/1984 | Japan . |
| 27268 | 8/1984 | Japan . |

*Primary Examiner*—E. R. Kazenske
*Assistant Examiner*—Michael D. Folkerts
*Attorney, Agent, or Firm*—Wolf, Greenfield & Sacks

[57] ABSTRACT

An improved blade replaceable type barber razor including a razor body comprising a handle portion and a first blade holder half made integral with the handle portion, a second blade holder half adapted to be hinge connected to the first one and slidable wedge for firmly clamping a blade between both the clamping surfaces of the first and second holder halves by its sliding movement in the slide groove in the longitudinal direction is disclosed. A recess is provided in the corner area as defined between the forward end face of the slide groove and the inner wall of the one blade holder half and a projection projected from the inner wall of the other blade holder half is provided in the corner area as defined by the forward end face of the slide groove and the inner wall of the other blade holder half. When the projection on the other holder half is brought in engagement to the recess on the one holder half when the second holder half is assembled with the razor blade while a blade is firmly clamped between both the clamping surfaces of the holder halves, unexpected sliding movement of the second holder half in the longitudinal direction is inhibitied reliably.

7 Claims, 10 Drawing Figures

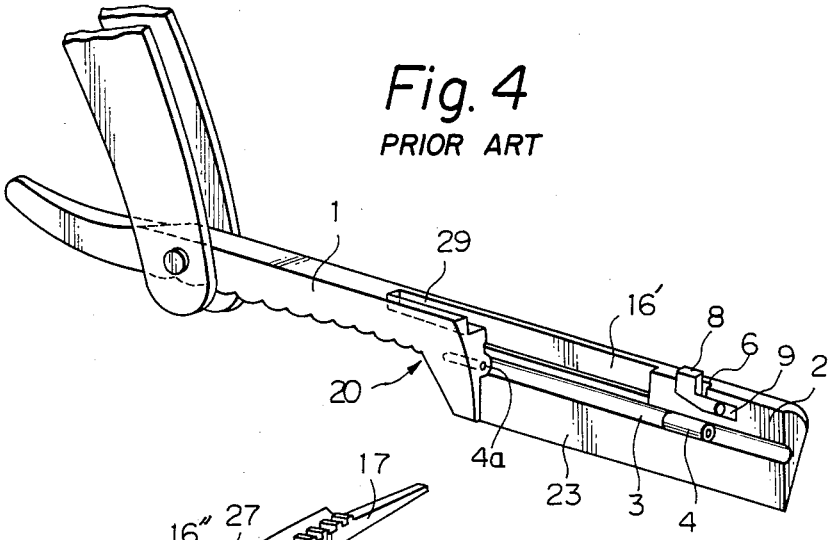
Fig. 4
PRIOR ART
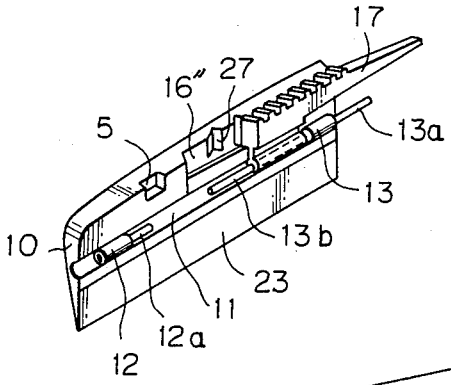
Fig. 5
PRIOR ART
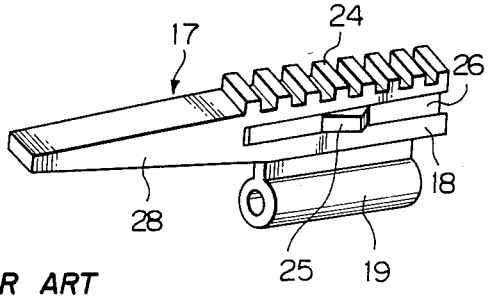
Fig. 6 PRIOR ART
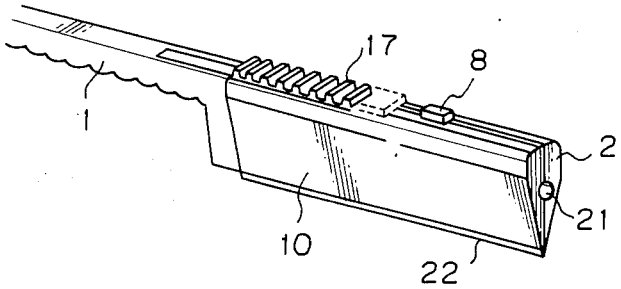

BLADE REPLACEABLE TYPE BARBER RAZOR

BACKGROUND OF THE INVENTION

1. Field of the Invention

The present invention relates to a blade replaceable type barber razor and more particularly to improvement of or relating to a barber razor of the type including a razor body comprising a handle portion and a first blade holder half made integral with the handle portion, a second blade holder half adapted to be operatively engaged to the first one in the form of hinge connection, the second blade holder half serving as a cover for the razor body, and a slidable wedge for firmly clamping a blade between both the clamping surfaces of the first and second blade holder halves by sliding movement of the slidable wedge in the forward direction.

2. Description of the Prior Art

A blade replaceable type barber razor including a razor body comprising a handle portion and a first blade holder half made integral with the handle portion, a second blade holder half adapted to be operatively engaged to the first one in the form of hinge connection to hold a blade therebetween and a slidable wedge for firmly clamping the blade between both the clamping surfaces of the first and second blade holder halves by its sliding movement in a slide groove in the forward direction which is formed in the ridge portions of the first and second blade holder halves located above the axis of hinge pins is already well known (for instance, see U.S. Pat. No. 3,772,778).

Further, another blade replaceable barber razor of the above-mentioned type including first and second blade holder halves which is constructed such that hinge pins are fixedly secured to the first or second blade holder half and hinge pin holes for allowing the hinge pins to be inserted thereinto are formed on the second or first blade holder half so that the hinge pins are inserted into the pin holes by sliding movement of the second blade holder half relative to the razor body in the longitudinal direction and thereby the second blade holder is hinge connected to the first blade holder half is also known from U.S. Pat. Nos. 4,285,125 and 4,454,653 and moreover it is disclosed in Japanese Utility Model Application No. 145928/1982 (Japanese Utility Model Publication No. 27267/1984) and Japanese Utility Model Application No. 90814/1983 (Japanese Utility Model Publication No. 27268/1984) both of which were filed by the same inventor as that of the present invention, the latter being a divisional utility model application of the former.

However, it has been found that the barber razor as disclosed in Japanese Utility Model Application No. 90814/1983 has a drawback that the second blade holder half which function as a cover for the razor body tends to slide toward the foremost end of the razor body under the effect of existence of friction during actuation of the slidable wedge and in an extreme case it is disconnected from the razor body.

On the other hand, the barber razor as disclosed in Japanese Utility Model Application No. 145928/1982 has also drawbacks that it is complicated in structure, manufactured at an expensive cost and has not good appearance, because it is provided with a locking pawl and a recess to which the former comes in engagement in order to inhibit the second blade holder half from slidably moving relative to the razor body in the direction of axis of the hinge pin.

SUMMARY OF THE INVENTION

Thus, the present invention has been made with the foregoing background in mind and its object resides in providing an improved barber razor of the early mentioned type which is entirely free from the drawbacks inherent to the conventional ones.

Another object of the present invention is to provide an improved barber razor which can be manufactured at an inexpensive cost.

To accomplish the above objects there is proposed according to the invention a blade replaceable type barber razor including a razor body comprising a handle portion and a first blade holding half made integral with the handle portion, a second blade holder half adapted to be engaged to the first blade holder half in the form of hinge connection so as to clamp a blade between the clamping surfaces of the blade holder halves and a slidable wedge slidable in a slide groove extending substantially in parallel with the axis of hinge in the ridge portions of both the blade holder halves, the slidable wedge having an opposing pair of side surfaces which are brought in wedging engagement to the side wall surfaces of the slide groove, wherein the first holder half and/or the second holder half has hinge pins fixedly secured thereto which are adapted to be inserted into associated pin holes on the second holder half and/or the first holder half so that the first and second holder halves are engaged to one another in the form of hinge connection about the hinge pins inserted in the pin holes by sliding movement of the second holder half relative to the razor body, the improvement consisting in that a recess is provided in the corner area as defined between the forward end face of the slide groove and the inner wall surface of the first holder half located opposite to the first clamping surface relative to the axis of hinge pins and a projection projected from the inner wall surface of the second holder half toward the first holder half to come in engagement to the recess is provided in the corner area as defined by the forward end face of the slide groove and the inner wall surface of the second holder half located opposite to the second blade clamping surface relative to the axis of hinge pins and that the height of the projection is so determined that it is not larger than the width of a clearance which is created between both the wall surfaces of the first and second holder halves when no blade is clamped therebetween but when a blade is clamped therebetween, the projection comes in engagement to the recess.

The slidable wedge is preferably provided with a leaf spring with a raised portion formed thereon at least on one of the side surfaces thereof which are adapted to slide along the side wall surface of the slide groove and a recess is formed on the side wall surface of said slide groove at the position located opposite to said raised portion so that undesirable sliding movement of the wedge is inhibited by engagement of the raised portion to the recess.

The slidable wedge is also preferably provided with a cylindrical portion which is adapted to slide in the cylindrical hollow space which is built by a combination of longitudinally extending grooves having the semicircular cross sectional configuration on both the first and second blade holder halves. Further, the cylindrical portion is formed with a longitudinally extending through hole into which a guide pin fixedly secured to the first or second holder half is slidably inserted.

Other objects, features and advantages of the invention will become more clearly apparent from reading of the following description which has been prepared in conjunction with the accompanying drawings.

BRIEF DESCRIPTION OF THE DRAWINGS

The accompanying drawings will be briefly described below.

FIG. 4 is a perspective view of a barber razor according to the second prior invention, shown in the disassembled state;

FIG. 5 is a perspective view of a slidable wedge usable for the barber razor in FIG. 4;

FIG. 6 is a perspective view of the barber razor in FIG. 4, shown in the operative state with a blade fitted thereto (the position where the slidable wedge reaches the foremost end is shown by dotted lines and the position where it reaches the rear most end is shown by solid lines);

DETAILED DESCRIPTION OF THE PREFERRED EMBODIMENT

To facilitate understanding of the present invention it will be helpful that barber razors of our prior invention are described in more details as follows.

Figure 1:
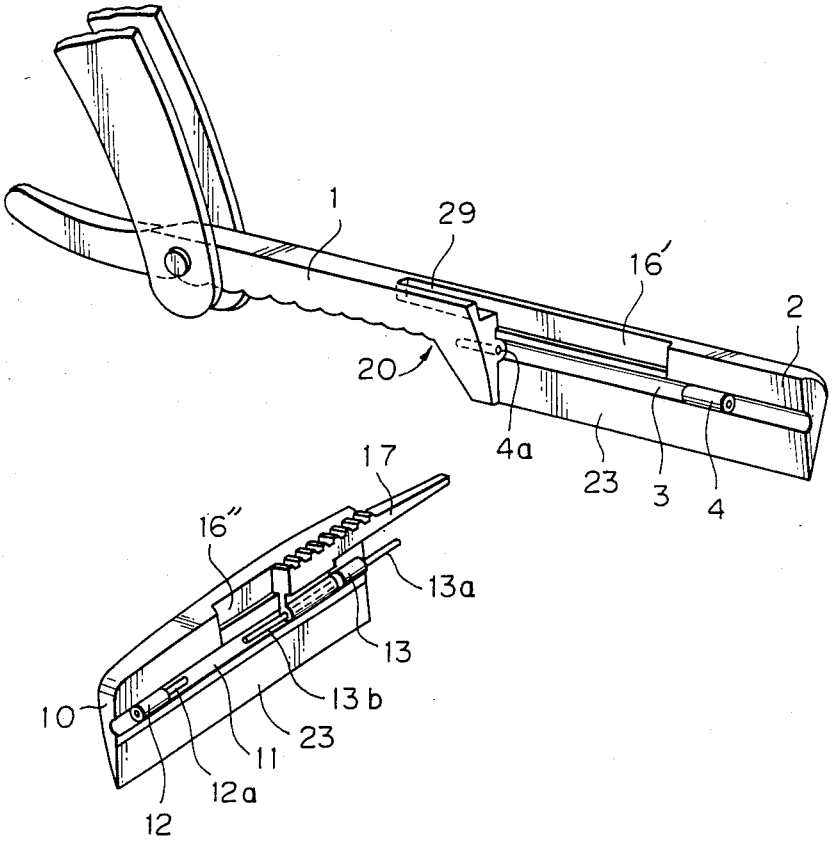
Fig. 1 PRIOR ART
FIG. 1 is a perspective view of a barber razor according to the first prior invention, shown in the disassembled state.
Figure 2:
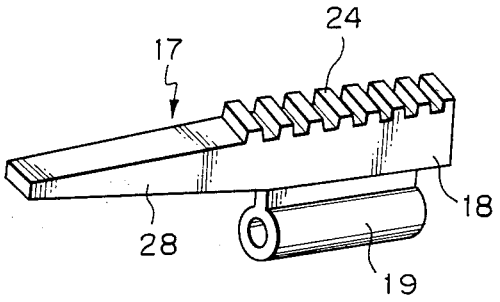
Fig. 2 PRIOR ART
FIG. 2 is a perspective view of a slidable wedge usable for the barber razor in FIG. 1.
Figure 3:
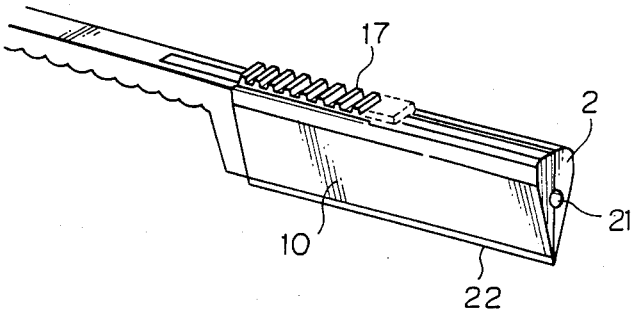
Fig. 3 PRIOR ART
FIG. 3 is a perspective view of the barber razor in FIG. 1, shown in the operative state with a blade fitted thereto (the position where the slidable wedge reaches the foremost end is shown by dotted lines and the position where it reaches the rearmost end is shown by solid lines)
Figure 7:
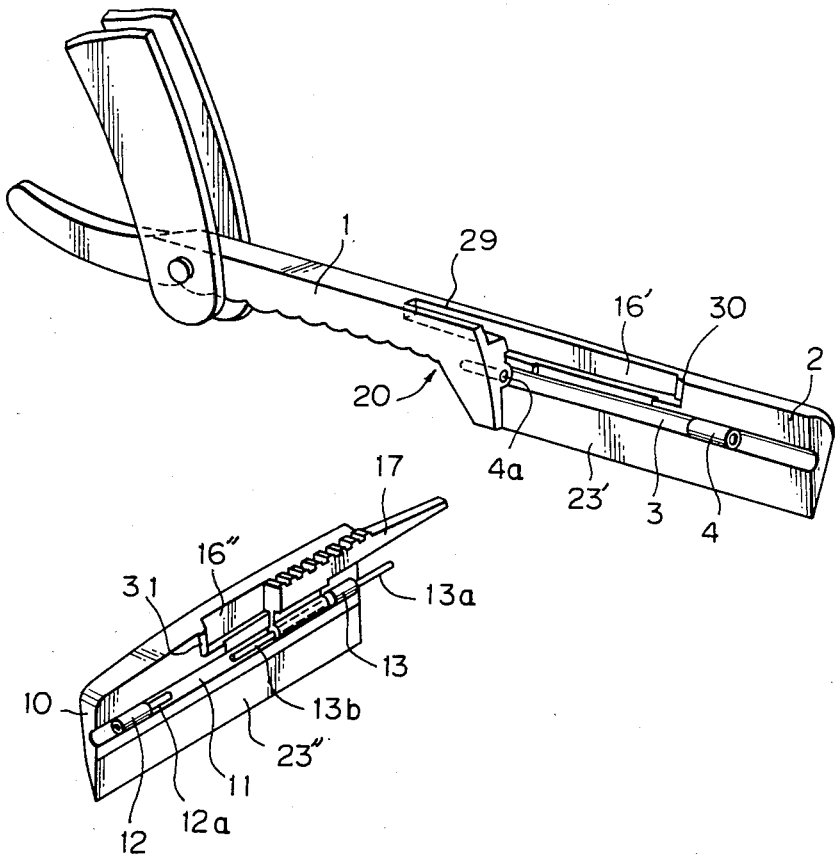
FIG. 7 is a perspective view of a barber razor according to an embodiment of the present invention, shown in the disassembled state.
Figure 8:
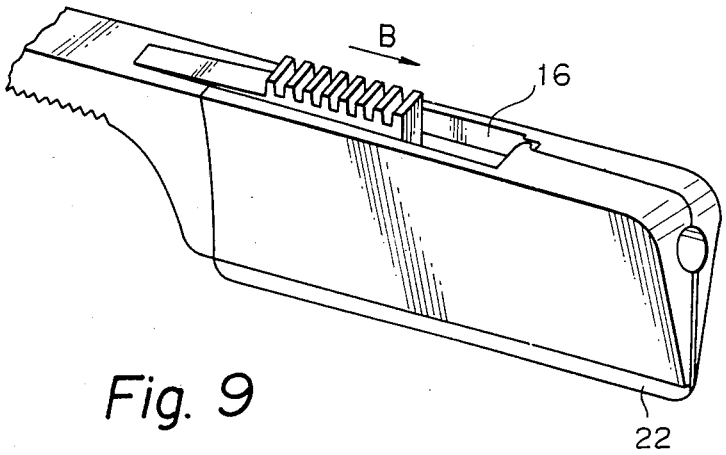
FIG. 8 is a fragmental perspective view of the barber razor in FIG. 7, particularly illustrating that components are assembled with a blade inserted between an opposing pair of clamping surfaces of blade holder halves and thereafter the slidable wedge is displaced forwardly so as to firmly clamp the blade between them.

First, description will be made as to a barber razor as disclosed in Japanese Utility Model Application No. 90814/1984 with reference to FIGS. 1 to 3.

A razor body 20 includes a handle portion 1 and a holder half 2 made integral with the handle portion 1 and a longitudinally extending groove 3 having the semicircular cross sectional configuration is recessed on the flat surface of the holder half 2. As is apparent from FIG. 1, a tubular piece 4 is fixedly fitted to the groove 3 at the predetermined position located around at the middle thereof. Another holder half 10 which functions as a cover for the razor body 20 has the configuration substantially symmetrical relative to the holder half 2 and therefore a longitudinally extending groove 11 is recessed at the position corresponding to the groove 3 on the holder half 2 so that an elongated hollow space having the circular cross sectional configuration is built by a combination of both the grooves 3 and 11 when both the halves 2 and 10 are assembled in the face-to-face relation. A tubular piece 12 is fixedly fitted to the groove 11 on the holder half 10 at the position located offset from the tubular piece 4 on the holder half 2 toward the foremost end of the razor body 20 and moreover another tubular piece 13 is fixedly fitted to the groove 11 in the same manner as the tubular piece 12 at the position located in the proximity of the handle portion 1. Each of the tubular pieces 12 and 13 carries a hinge pin as identified by reference numerals **12*a* and 13*a* which extends in the longitudinal direction toward the handle portion 1. The length and the position of the tubular pieces 4, 12 and 13 as well as the length of the hinge pins 12*a* and 13*a* are so determined that when the holder half 10 is assembled with the holder half 2 in the face-to-face relation at the position where the former is located offset toward the foremost end by a certain distance and the holder half 10 is slidably displaced toward the handle portion 1, the hinge pin 12*a* is inserted into the pin hole on the tubular piece 4 and at the same time the hinge pin 13*a* is inserted into a pin hole 4*a* on the end face located at the foremost end of the handle portion 1. Thus, hinge type connection has been achieved between both the holder halves 2 and 10** in the above-described manner.

In the illustrated barber razor the holder half 10 has two hinge pins **12*a* and 13*a*. Alternatively, the holder half 2 may have two hinge pins. Further, alternatively, one hinge pin may be allocated to the holder half 10 and another hinge pin may be allocated to the holder half 2**.

A blade 22 is firmly clamped between both clamping surfaces 23' and 23'' on the inner walls of the holder halves 2 and 10. To assure that a certain clearance is created between both the clamping surfaces 23' and 23'' when used blade is replaced with new one and a sufficiently high intensity of clamping force is maintained during operation of a blade there is provided a wedging mechanism. Specifically, both the holder halves 2 and 10 are formed with wedging surfaces 16' and 16'' along their ridge. The wedging surface 16' of the holder half 2 is located opposite to the wedging surface 16'' of the holder half 10 so that there is created a slide groove 16. Thus, the slide groove 16 includes both the side surfaces constituted by the wedging surfaces 16' and 16'' which are tapered toward the foremost end of the razor body 20 whereby a slidable wedge 17 can slide forwardly along the side surfaces of the slide groove 16. As the slidable wedge 17 is manually displaced toward the foremost end of the razor body 20, both the holder halves 2 and 10 are caused to turn about the hinge pins **12*a* and 13*a* and thereby both the clamping surfaces 23' and 23'' are brought in firm contact with one another with the blade 22** interposed therebetween and thereby the latter is immovably clamped.

To assure that the slidable wedge 17 is slidably held in the slide groove 16 and moreover sliding movement of the wedge 17 is correctly guided, the wedge 17 is integrally provided with a cylindrical portion 19 which is adapted to slide in the cylindrical hollow space which is built by a combination of both the longitudinally extending grooves 3 and 11 on the holder halves 2 and 10.

Further, to inhibit the wedge 17 from being parted away from either the razor body 20 or the holder half 10 when the latter is disconnected from the former, a guide pin 13*b* is projected from the tubular piece 13 of the holder half 10 in the opposite direction to projection of the hinge pin 13*a* so that it is inserted through a hole in the cylindrical portion 19. The length of the cylindrical portion 19 and that of the guide pin 13*b* are so determined that relative sliding movement of both the holder halves 2 and 10 in the longitudinal direction is achieved without any trouble when the holder half 10 is assembled with the razor body 20 or it is disassembled from the latter. As is apparent from the drawings, the slidable wedge 17 is formed with a number of indentions (notches) on the top surface thereof for the purpose of inhibiting an occurrence of slippage of an operator's finger.

When the distance between the oppositely located free ends of the hinge pin 12*a* and the guide pin 13*b* is determined shorter than the length of the cylindrical portion 19 of the wedge, there is no fear of causing the wedge 17 to be disconnected from the holder half 10 when the latter is disassembled from the razor body 20.

It is preferable that the slidable wedge 17 is provided with a cover extending from the wedge portion to the handle portion 1 so that the cover comes in and out of a groove 29 on the ridge of the handle portion 1 as the slidable wedge 17 effects its sliding movement. It should be noted that the cover is disposed mainly from the viewpoint of appearance so as to inhibit the interior between both the holder halves 2 and 10 from being visually observed through the slide groove 16 when the slidable wedge 17 is displaced toward the foremost end of the razor body 20.

As described above, the cylindrical hollow space is built by a combination of the longitudinally extending grooves 3 and 11 on both the holder halves 2 and 10. Preferably, the foremost end of the cylindrical hollow space exposed to the outside is used as insert hole through which a projecting rod of the blade replacing device is inserted.

As the wedge 17 slides along the wedging surfaces 16' and 16'', the latter are affected by frictional force which is oriented in the direction of sliding movement of the wedge 17. When the wedge 17 is slidably displaced toward the foremost end of the razor body 20 to clamp a blade 22 between both the clamping surfaces 23' and 23'', the holder half 10 tends to be thrusted along the axis of hinge pins toward the foremost end of the razor body 20, that is, in the direction of disassembling of the holder half 10 from the razor body 20 under the effect of the aforesaid frictional force. This means that the holder half 10 is caused to slide away from the razor body 20 in the disassembling direction. In an extreme case there is caused such a trouble that the holder half 10 is disconnected from the razor body 20 and falls down on the floor.

Next, description will be made as to another barber razor as disclosed in Japanese Utility Model Application No. 145928/1982 with reference to FIGS. 4 to 6. Parts or components constituting the barber razor as disclosed in this prior invention are designed and constructed in the same manner as those in FIGS. 1 to 3 excluding the points as described below. Accordingly, same or similar parts or components in FIGS. 4 to 6 as those in FIGS. 1 to 3 are identified by same reference numerals.

Referring to FIGS. 4 to 6, the holder half 10 is provided with a locking device which serves to lock it relative to the razor body 20 in the longitudinal direction in order to inhibit the holder half 10 from sliding further in the direction away from the razor body 20 (in an extreme case, in order to inhibit it from falling down from the latter). Specifically, a locking pawl 8 with a resilient plate 9 attached thereto is fitted to the ridge portion of the holder half 2 on the upper part of the clamping surface 23. Once the holder half 10 has been assembled with the razor body 20, the locking pawl 8 is normally caused to enter the recess 5 which is formed on the ridge portion of the holder half 10 at the position located opposite to the locking pawl 8 whereby sliding movement of the holder half 10 in the longitudinal direction away from the razor body 20 is inhibited reliably. As is apparent from FIG. 4, a recess 6 similar to the recess 5 is formed on the ridge portion of the holder half 2. When the holder half 10 is disassembled from the razor body 20, the locking pawl 8 is first displaced from the recess 5 on the holder half 10 against resilient force of the resilient plate 9 and it is then caused to enter the recess 6 on the holder half 2. As a result, the locking pawl 8 is released from the locked state (by thrusting the upper part of the locking pawl by an operator's finger in the transverse direction). Since the locking pawl 8 is adapted to enter the recess 6 on the holder half 2 during sliding movement of the holder half 10 relative to the razor body 20 in the longitudinal direction, assembling and disassembling of the holder half 10 is achieved without any hindrance encountered. In the drawings, the locking pawl 8 is shown to be disposed on the holder half 2. Alternatively, it may be disposed on the holder half 10.

The wedge portion 18 of the slidable wedge 17 is provided with a leaf spring 26 having a raised portion 25 formed thereon, the leaf spring 26 being received in a recess on the one side wall of the wedge portion 18 located opposite to the holder half 10. On the other hand, the holder half 10 is formed with a single or a plurality of recess(es) 27 on the wedging surface 16'' so that the raised portion 25 of the leaf spring 26 comes in resilient engagement to the recess(es) 27. As a result, sliding movement of the slidable wedge 17 can be stopped. It is preferable that the recess 27 extends upwardly to the ridge of the holder half 10 so as to enable resilient engagement of the raised portion 25 of the leaf spring 26 to the recess 27 to be visually confirmed by an operator.

In the drawings, the leaf spring 26 is shown to be disposed on the wall surface of the wedging portion 18 of the slidable wedge 17 located opposite to the holder half 10. Alternatively, it may be disposed on the wall surface of the holder half 10 with the recess 27 being provided on the wedging surface 16' of the holder half 2. Further, alternatively, a single leaf spring 26 may be disposed on each of the wall surfaces of the wedging portion 18 of the slidable wedge 17 with recesses 27 being formed on each of the wedging surfaces 16' and 16''.

The above described barber razor is constructed such that holder halves are provided with locking pawl and coacting recess. Arrangement of the barber razors made in that way leads to disadvantageous features such as complicated structure, increased manufacturing cost, unpleasant appearance and others.

Now, the present invention will be described in a greater detail hereunder with reference to FIGS. 7 to 10 which illustrate a preferred embodiment of the invention. Since the barber razor of the invention is apparently similar to those as illustrated in FIGS. 1 to 6 excluding the following points, same or similar parts or components in FIGS. 7 to 10 as those in FIGS. 1 to 6 are identified by same reference numerals.

The present invention consists in that the barber razor is constructed in such a manner as described below so as to obviate the foregoing drawbacks inherent to the conventional barber razors.

A slide groove 16 is built by an opposing pair of wedging surfaces 16' and 16" on both the holder halves 2 and 10 constituting the razor body 20.

A characterizing feature of the barber razor is that a recess 30 is provided in the corner area as defined by the fore end face of the slide groove 16 on the holder half 2 (that is, the shoulder stepped between the wedging surface 16' and the inner wall surface of the holder half 2) and the inner wall surface of the holder half 2, and a projection 31 projected toward the razor body 20 from the inner surface of the holder half 10 is provided in the corner area as defined by the fore end face of the slide groove 16 on the holder half 10 (that is, the shoulder stepped between the wedging surface 16" and the inner wall surface of the holder half 10) and the inner wall surface of the holder half 10.

An important thing relative to the barber razor of the invention is how high the projection 31 is projected from the inner surface of the holder half 10. Specifically, the height of the projection 31 is so determined that it is equal the width of a clearance A (see FIG. 10) which is created in the ridge portions of both the holder halves 2 and 10 between them when the holder half 10 is assembled with the razor body 20 in the form of hinge connection with no blade being clamped between both the holder halves 2 and 10 or it is a little less than the width of the aforesaid clearance A. It should be noted that the projection 31 comes in contact with the recess 30 when a blade is clamped between both the holder halves.

Figure 9:
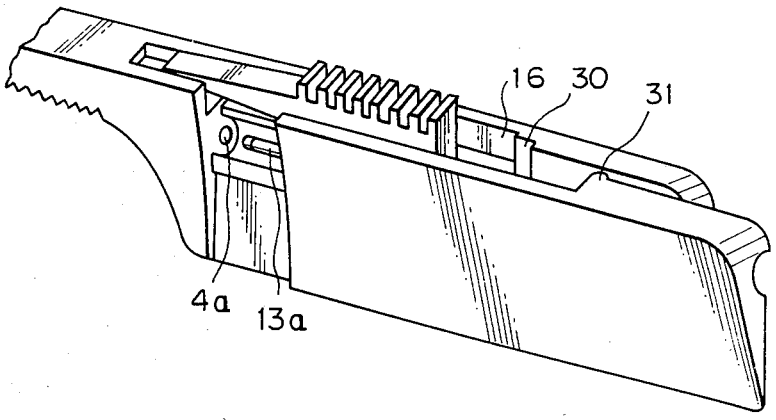
FIG. 9 is a fragmental perspective view of the barber razor in FIG. 7, particularly illustrating how the second blade holder half is slidably displaced relative to the razor body so as to effect assembling or disassembling.
Figure 10:
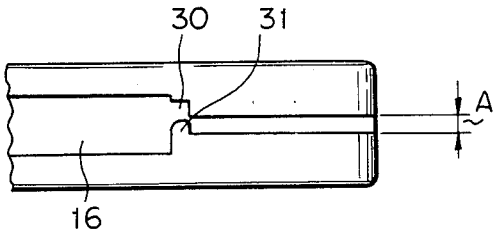
FIG. 10 is a fragmental plan view of the barber razor in FIG. 7, shown in an enlarged scale to particularly illustrate how a projection on the one holder half comes in engagement to a recess on the other holder half.

Since the inner walls of both the holder halves 2 and 10 can be parted away from one another by a distance equal to the clearance A in the area of their ridge portions when the holder half 10 is assembled with the razor body 20 in the form of hinge connection or when the holder half 10 is disassembled from the razor body 20 after the used blade is removed from the latter, sliding movement of the holder half 10 relative to the razor body 20 is achieved smoothly without any engagement of the projection 31 to the recess 30 (see FIG. 9). However, after a new blade 22 is inserted into the space as defined between both the clamping surfaces 23' and 23", both the holder halves 2 and 10 are caused to turn about the hinge pins whereby a clearance between the inner walls of both the holder halves 2 and 10 is reduced by a distance equal to the thickness of the replaced blade 22 and the projection 31 comes in engagement to the recess 30 (see FIG. 8). As a result that sliding movement of the holder half 10 relative to the razor body 20 is inhibited, the holder half 10 is immovably held by engagement of the projection 31 to the recess 30 and therefore, there is no fear of causing such a malfunction that the holder half 10 is disconnected from the razor body 20 due to unexpected sliding movement thereof, even when the slidable wedge 17 is thrusted toward the foremost end of the razor body 20 (in the direction as identified by an arrow mark B in FIG. 8) by an operator's finger.

In the illustrated embodiment, the projection 31 is designed in the form of a linearly extending rail but the present invention should not be limited only to this. Alternatively, it may be designed in the form of a series of point-shaped projections having the cylindrical or conical configuration.

It should of course be understood that the present invention should not be limited only to the illustrated embodiment but change or modification may be made in a suitable manner as illustrated in FIGS. 4 and 5. Namely, the barber razor may be provided with a leaf spring 26 with a raised portion formed thereon, the leaf spring 26 being received in a recess on the one side wall of the slidable wedge 17, so that the raised portion 25 is engaged to a recess on the wedging surface 16' and/or 16" so as to assure that undesirable sliding movement of the wedge 17 is inhibited reliably.

What is claimed is:

1. In a blade replaceable type barber razor including a razor body comprising a handle portion and a first blade holder half made integral with said handle portion, a second blade holder half engaged by a hinge connection to said first blade holder half for clamping a blade between a first blade clamping surface of said first holder half and a second blade clamping surface of said second holder half, said second blade holder half serving as a cover for the razor body and a slidable wedge slidably in a slide groove extending substantially in parallel with the axis of the hinge connection, in ridge portions of both the blade holder halves, said slidable wedge having an opposing pair of side surfaces which are brought in wedging engagement to inner side wall surfaces of the slide groove, wherein at least one of the first holder half and the second holder half has hinge pins fixedly secured thereto which are adapted to be inserted into associated pin holes on at least one of the second holder half and the first holder half so that the first holder half and the second holder half are engaged to one another by said hinge connection about the hinge pins inserted in the pin holes by sliding movement of the second holder half relative to the razor body, the improvement consisting in that a recess is provided in the corner area as defined between a forward end face of the slide groove and the inner wall surface of the first holder half located opposite to the first blade clamping surface and a rigid projection, projected from the inner wall surface of the second holder half toward the first holder half to come in engagement with said recess, is provided in the corner area as defined by the forward end face of the slide groove and the inner wall surface of the second holder half located opposite to the second blade clamping surface and that the height of said rigid projection is so determined that when no blade is clamped between the first and second holder half, the projection is allowed to move out of engagement with the recess by movement of the second holder half around the hinge connection relative to the first holder half, but when a blade is clamped, the projection comes in engagement with the recess.

2. A barber razor as defined in claim 1, wherein the slidable wedge is provided with a cylindrical portion which is adapted to slidably move in a cylindrical hollow space which is built by a combination of longitudinally extending grooves having the semicircular cross sectional configuration on both the first and second blade holder halves, said cylindrical hollow spaced extending along the axis of the hinge pins, and that the cylindrical portion is formed with a through hole into which a guide pin fixedly secured to one of the first holder half and the second holder half is slidably inserted, said guide pin extending along the axis of the hinge pins.

3. A barber razor as defined in claim 2, wherein the guide pin and the hinge pin, having free ends thereof extending towards each other, are fixedly secured to one of the first holder half and the second holder half, and a distance between the free end of the guide pin and the free end of the hinge pin is determined shorter than the length of the cylindrical portion so that the slidable wedge is inhibited from being readily disconnected from the razor body or the second blade holder half.

4. A barber razor as defined in claim 1, wherein the slidable wedge is provided with a leaf spring with a raised portion formed thereon at least on one of the side surfaces thereof which are adapted to slide along the slide groove and a recess is formed on the side wall surface of said slide groove at the position located opposite to said raised portion so that undesirable sliding movement of the wedge is inhibited by engagement of the raised portion to the recess.

5. A barber razor as defined in claim 4, wherein a plurality of recesses are provided on the side wall surface of the slide groove in the direction of sliding movement of the slidable wedge.

6. A barber razor as defined in claim 4, wherein the leaf spring is provided on each of the side surfaces of the slidable wedge and the recess adapted to receive therein the raised portion of the leaf spring is formed on each of the side wall surfaces of the slide groove.

7. A barber razor as defined in claim 1, wherein the slidable wedge includes a cover portion which cxtends into the handle portion.

* * * * *